US010058905B2

(12) United States Patent
Krautschick et al.

(10) Patent No.: US 10,058,905 B2
(45) Date of Patent: Aug. 28, 2018

(54) METHOD AND DEVICE FOR MANUFACTURING PROFILED METAL STRIPS

(71) Applicant: OUTOKUMPU NIROSTA GmbH, Krefeld (DE)

(72) Inventors: Jochen Krautschick, Solingen (DE); Jörn Teipel, Köln (DE); Dirk Wiemer, Düsseldorf (DE)

(73) Assignee: Outokumpu Nirosta GmbH, Krefeld (DE)

( * ) Notice: Subject to any disclaimer, the term of this patent is extended or adjusted under 35 U.S.C. 154(b) by 167 days.

(21) Appl. No.: 14/653,215

(22) PCT Filed: Dec. 19, 2013

(86) PCT No.: PCT/EP2013/077359

§ 371 (c)(1),
(2) Date: Jun. 17, 2015

(87) PCT Pub. No.: WO2014/096180

PCT Pub. Date: Jun. 26, 2014

(65) Prior Publication Data

US 2015/0336143 A1 Nov. 26, 2015

(30) Foreign Application Priority Data

Dec. 19, 2012 (DE) ..... 10 2012 024 808

(51) Int. Cl.
*B21B 27/00* (2006.01)
*B21B 13/04* (2006.01)
(Continued)

(52) U.S. Cl.
CPC ..... *B21B 27/005* (2013.01); *B21B 1/227* (2013.01); *B21B 39/02* (2013.01); *B21D 13/04* (2013.01); *B21D 13/10* (2013.01)

(58) Field of Classification Search
CPC ..... B21D 13/00; B21D 13/04; B21D 13/10; B21B 27/005; B21B 1/227; B21B 39/02; B21B 37/58
See application file for complete search history.

(56) References Cited

U.S. PATENT DOCUMENTS 1,952,181 A * 3/1934 Newill ..... B21D 13/04 242/538.2
3,415,096 A * 12/1968 Griswold ..... H01B 7/0861 72/385
(Continued)

FOREIGN PATENT DOCUMENTS

DE 3416841 A1 11/1985
GB 2063735 A 6/1981
(Continued)

OTHER PUBLICATIONS

Quick Ship Metals website from Nov. 14, 2009; http://www.quickshipmetals.com/foils/crafting-scrapbooking-foil-coil.html.*
(Continued)

*Primary Examiner* — Pradeep C Battula
(74) *Attorney, Agent, or Firm* — Chernoff Vilhauer LLP

(57) ABSTRACT

The invention relates to a method for manufacturing profiled metal strips (1, 1'), in which a metal strip (1, 1') with predefinable material thickness consisting, in particular, of stainless steel is wound up on a coil (4) and guided through a rolling stand (W1-W4) containing several rolls (2, 3, 2', 3'), wherein at least the rolls (2, 3) that effectively interact with the metal strip (1, 1') are provided with a predefinable topography (8, 9), by means of which profiles with profile depths >250 μm can be produced on both sides of the metal strip (1, 1') depending on the geometry of the topography (8, 9) of the rolls (2, 3), and wherein the metal strip (1, 1') is
(Continued)

Figure 1:
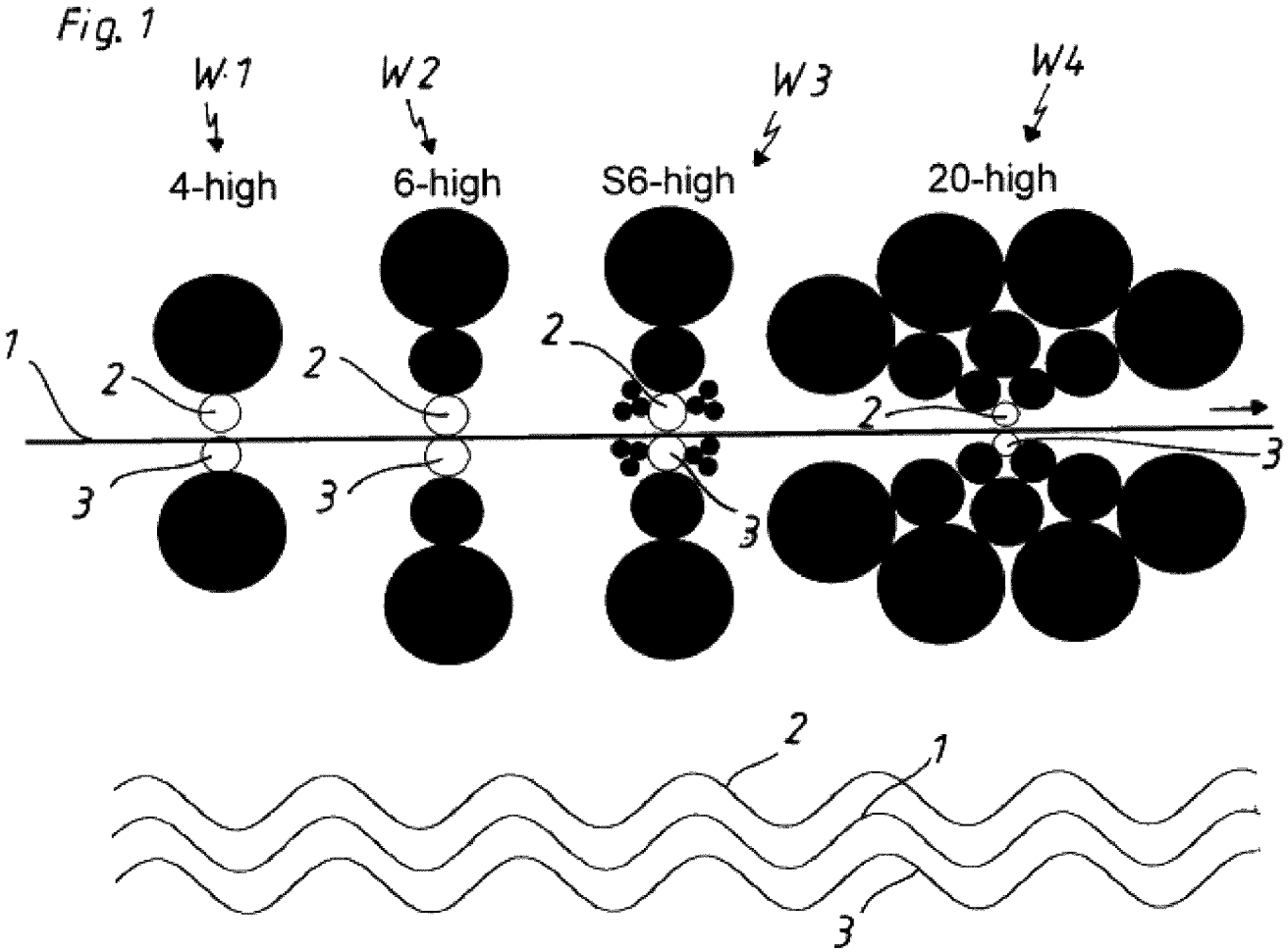

Fig. 6 subsequent to its profiling wound up on a coil (5) and, if so required, subjected to a thermal post-treatment.

6 Claims, 8 Drawing Sheets

(51) Int. Cl.

| | |
|---|---|
| ***B21B 1/22*** | (2006.01) |
| ***B21B 39/02*** | (2006.01) |
| ***B21D 13/04*** | (2006.01) |
| ***B21D 13/10*** | (2006.01) |

(56) References Cited

U.S. PATENT DOCUMENTS

| | | | | |
|---|---|---|---|---|
| 4,137,741 | A * | 2/1979 | Fapiano | B21B 37/28 700/154 |
| 5,311,935 | A * | 5/1994 | Yamamoto | B60H 1/00328 165/152 |
| 6,594,896 | B2 * | 7/2003 | Morihira | B21D 13/00 29/557 |
| 8,402,805 | B2 * | 3/2013 | Leon | B64C 3/26 72/226 |
| 8,800,342 | B2 * | 8/2014 | Chauncey | B21D 13/04 72/185 |
| 9,505,167 | B2 * | 11/2016 | Boegli | B21D 13/04 |
| 2006/0283529 | A1 * | 12/2006 | Ghosh | B21D 13/04 148/557 |

FOREIGN PATENT DOCUMENTS

| | | | |
|---|---|---|---|
| GB | 2272662 | A | 5/1994 |
| GB | 2385816 | A | 9/2003 |
| JP | H071045 | A | 1/1995 |
| KR | 960006031 | B1 | 5/1996 |
| WO | 2011/008860 | A1 | 1/2011 |

OTHER PUBLICATIONS

UK largest indepdendent multi-metals stockholder; http://www.aalco.co.uk/datasheets/Stainless-Steel-14301-Bar-and-Section_34.ashx.*

"Creative Accents: Patterned Strips and Sheets", vol. 4, Edition Mar. 2005, ThyssenKrupp Nirosta, 6 pgs.

Search report from corresponding International Application No. PCT/EP2013/077359, dated Apr. 15, 2014, 3 pgs.

* cited by examiner

METHOD AND DEVICE FOR MANUFACTURING PROFILED METAL STRIPS

CROSS-REFERENCE TO RELATED APPLICATION

This is a national stage application filed under 35 U.S.C. 371 based on international Application No. PCT/EP2013/077359 filed Dec. 19, 2013 and claims priority under 35 U.S.C. 119 of German Utility Patent Application No. 10 2012 024 808.3 filed Dec. 19, 2012.

STATE REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

Not Applicable.

The invention pertains to a method for manufacturing profiled metal strips.

It is generally known to produce profiles in metal bodies by means of metal forming operations. However, this metal forming technique is associated with high costs.

The KR 1996-0006031 A discloses a stainless steel sheet that is impressed on both sides. The pattern impressed on the back surface is pressed out on the front side so that the concave indentation can be formed on the back side of the stainless steel sheet and the embossed surface is formed on the front side. The pattern on the front side results in an irregular pattern while the pattern formed on the back side represents a continuous uniform pattern. For example, a Sendzimir rolling stand containing an upper and a lower embossing roll is used in this case, wherein the upper embossing roll controls the surface transmission number of the back pattern by means of the depth of the pattern and the upper embossing roll appears by means of the change of the reduction condition of the automatic control device and by bolting in the continuous-operating rolling stand.

Stainless steel sheets profiled in this fashion are referred to as patterned strips and sheets and illustrated, for example, in the prospectus (Creative Accents: Patterned Strips and Sheets), Volume 4, Edition March 2005 of the firm ThyssenKrupp Nirosta.

During the patterning operation, a pattern roll is normally used on one side in order to impress a design into the surface. A smooth roll is typically utilized on the opposite side. A slight through-impression of the pattern occurs on the back side in this case. The impression depths on the side of the pattern roll amount up to 30 μm. Although the through-impression on the rear side lies below 1 μm, it is still visible in a coarse design.

In individual cases, a specially roughened roll or a roll with a different pattern is used on the back side, for example, as disclosed in the KR 1996-0006031 A. Since the patterns are not exactly adapted to one another geometrically, the depth of the impression as always amounts to no more than approximately 30 μm on each side. In this case, the impression is superimposed with the slight through-impression of the other roll.

This method has not prevailed in practical applications because the impressed designs appear smeared due to the through-impression of the other pattern on the back side.

The WO publication 2011/008860 describes a process where a spacer for a sealed unit is formed of a stretched elongate strip. Stretching is performed by applying a tension across a segment of the elongated strip. For the tension the elongate strip is passed through at least two spaced sets of rollers, the first set of rollers operating at a first speed and the second set of rollers operating at a second speed.

The JP patent application H07-001045 relates to a method and device for manufacturing meandering corrugating material in a roll-forming so that the width reduction ratio in the plane following progressing corrugated corresponding part is larger than the width reduction ratio in the plane preceding progressing corrugated corresponding part. The starting material is a crosswise corrugated metal sheet.

The GB patent application 2272662 relates to a method of producing a sheet material of the kind specified wherein a plurality of teeth are provided on each of two rolls, the rolls are mounted for relative rotation that teeth on one roll extend into the gap between teeth on the other roll, and the rolls are driven at the same speed and the sheet material is passed between the rolls. Further, the overall thickness is determined by the heights of the projections at both surfaces of the sheet material and is substantially greater (not more than 3 to 4 times) than the gauge of the material.

The GB patent application 2063735 describes a method of forming projections on a piece of a sheet metal wherein the piece of the sheet metal is passed between a pair of rolls having at their circumferences respective formations which engage opposite surfaces of the sheet metal. The formations on one roll push the sheet metal into gaps between adjacent formations on the other roll. The formations are arranged in rows or in helical rows.

The GB patent application 2385816 describes an apparatus and a method for working a plain sheet to form an indented metal sheet. The apparatus is provided with a pair of spaced cylindrical rows, each of the rolls further providing around its circumstance with a plurality of equispaced circumferential rows of equispaced teeth.

The DE patent application 3416841 describes a method for the production of a water heater in which the water-carrying part is designed as a double-walled plate with outward-facing knobs and is wound into a spiral. The knobs are produced by means of rolls into the still hot material immediately following extrusion of half-shells of the water-carrying part.

BRIEF SUMMARY OF THE INVENTION

Not Applicable.

The invention is based on the objective of making available a method, by means of which the front side and the back side, in particular, of a stainless steel sheet can be profiled, if so required, with different geometric profiles in a continuous operation, wherein rolled profiles with the greatest possible impression depth should be produced.

The invention furthermore aims to make available a device, by means of which different profiles with the greatest possible predefinable impression depth can be produced on both sides of a sheet consisting, in particular, of stainless steel.

This objective is attained with a method for manufacturing profiled metal strips, in which a metal strip with predefinable material thickness consisting, in particular, of stainless steel is wound up on a coil and guided through a rolling stand containing several rolls, wherein at least the rolls that effectively interact with the metal strip are provided with a predefinable topography, by means of which profiles with profile depths >250 μm can be produced on both sides of the metal strip depending on the geometry of the topography of the rolls, and wherein the metal strip is subsequent to its profiling wound up on a coil and, if so required, subjected to a thermal post-treatment.

Advantageous enhancements of the inventive method are disclosed in the corresponding procedural dependent claims.

The objective of the invention is also attained with a device for manufacturing profiled metal strips that features a rolling stand containing several rolls, wherein at least one upper and at least one lower roll adjoin the upper and the lower surface of the metal strip under the influence of pressure, and wherein the upper and lower rolls adjoining the surfaces of the metal strip are provided with a positive and a negative topography that corresponds to a profile with a profile depth >250 μm to be produced on the metal strip.

Advantageous enhancements of the inventive device are disclosed in the corresponding objective dependent claims.

On the contrary to the prior art, opposite surfaces of wound-up sheets (coils) consisting, in particular, of stainless steel therefore can be processed by means of rolling, particularly cold-rolling, in a continuous operation, wherein profile depths in excess of 1000 μm can be realized.

This is achieved in that the upper and lower roll surfaces that effectively interact with the respective upper and lower surfaces of the sheet are respectively provided with two positive and negative topographies that are exactly adapted to one another.

As in the prior art, it is also possible to utilize multi-roll rolling stands such as, for example, Sendzimir rolling stands in order to technically realize the corresponding profiles.

The following principle applies in this respect: the softer the metallic material of the metal strip, the smaller the number of rolls used may be chosen.

The object of the invention makes it possible to form metal strips consisting, in particular, of stainless steel with the aid of a continuous rolling process, particularly a single-stage or multi-stage cold-rolling process, preferably in a multi-roll stand, to such a degree that they are provided with a wave structure in the rolling direction. It is furthermore possible to also manufacture strips with trapezoidal structures, bulge structures or honeycomb structures in this fashion.

The high forces, for example, of a Sendzimir rolling stand are intended for fully utilizing the ductility of the material (surface enlargement) and for making it possible to produce a significantly deeper structure than in the prior art. For example, a corrugated sheet metal with an effective thickness of 1.1 mm could be produced of a flat material with an original thickness of 0.50 mm. In a corrugated sheet metal structure, the corrugation spacing should amount to at least three-times the sheet metal thickness, but no more than approximately 2 cm.

As already mentioned above, the inventive method on the one hand and the inventive device on the other hand make it possible to manufacture rolled profiles with the greatest possible profile depth. The deeper the profile, the higher the flexural strength of the profiled sheet metal. The impression of the profile is associated with a deformation and thickness reduction of the sheet metal. The depth of the profile is chosen in such a way that the maximum deformability of the respective material is utilized up to shortly before tearing occurs.

The profiled coils can be annealed after the rolling operation in order to restore the original deformability of the sheet metal. An annealed profile makes it possible to manufacture components with significantly improved rigidity and reduced sheet metal thickness by means of suitable forming operations.

In addition to wave profiles, the inventive method and the inventive device respectively also make it possible to manufacture nub profiles. Wave profiles show a significant rigidity increased in one direction. At the same wavelength and amplitude, nub profiles show approximately half the rigidity increase of wave profiles, but are nearly isotopic in all directions.

The following marginal conditions are important for achieving the maximum material-dependent profile depth during the rolling operation and likewise apply to wave profiles and nub profiles:

- The wavelength of the profile needs to be greater than 3× original sheet metal thickness because the sheet metal can otherwise no longer freely flow between the upper roll and the lower roll.
- The radius in the nub/wave crest needs to be greater than 0.4× original sheet metal thickness because the risk of cracks in the crest is otherwise very high.
- The angle in the flank of the profile parallel to the rolling direction (measured from the normal of the plane of the original sheet metal) needs to be greater than 30° because the risk of fracturing the profiles of the rolls during the rolling operation otherwise increases.
- According to the preceding geometry specifications, the amplitude of the profile in the roll needs to be smaller or no greater than equal to 0.6× wavelength.
- The amplitude or the thickness of the profiled sheet metal to be rolled are adjusted with the rolling force. The maximum depth of the profile is determined for each material to be profiled from the literature on corresponding material/forming parameters.

The inventive method and the inventive device preferably are respectively intended for processing stainless steel sheets of the type 1.4301, wherein the maximum thickness reduction of this target material should amount to approximately 45%.

Conceivable fields of application are, for example, heat exchangers, bipolar plates for fuel cells, catalytic converter plates or the like, as well as decorative uses.

BRIEF DESCRPTION OF THE SEVERAL VIEWS OF THE DRAWINGS

Figure 2:
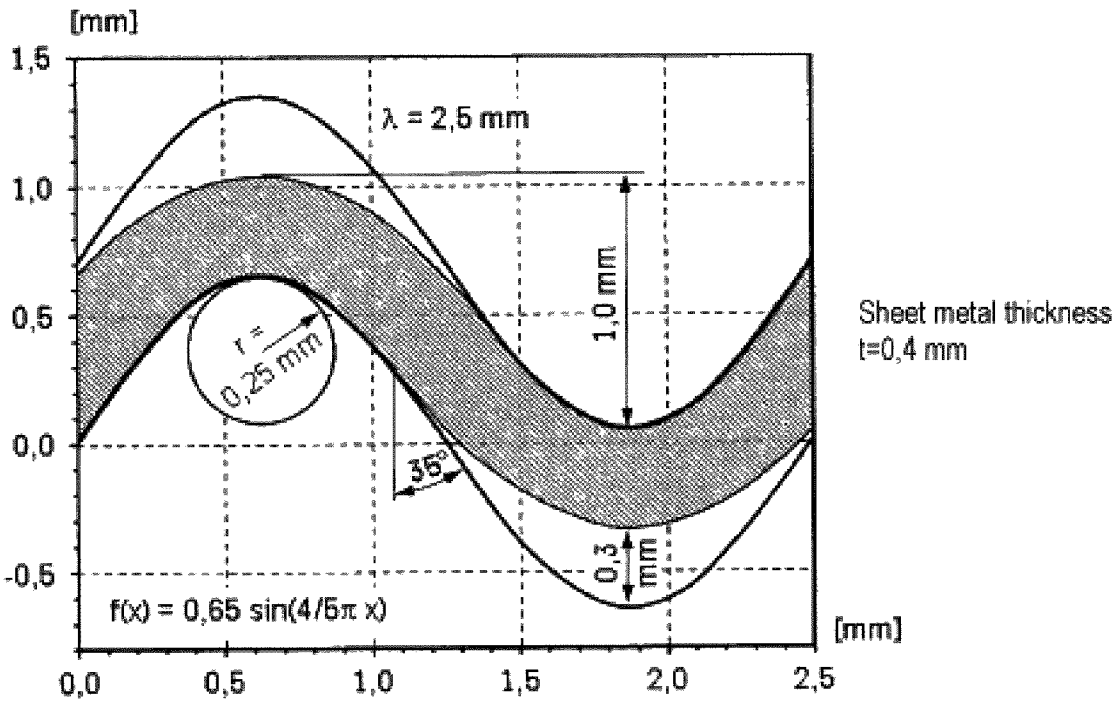
Figure 3:
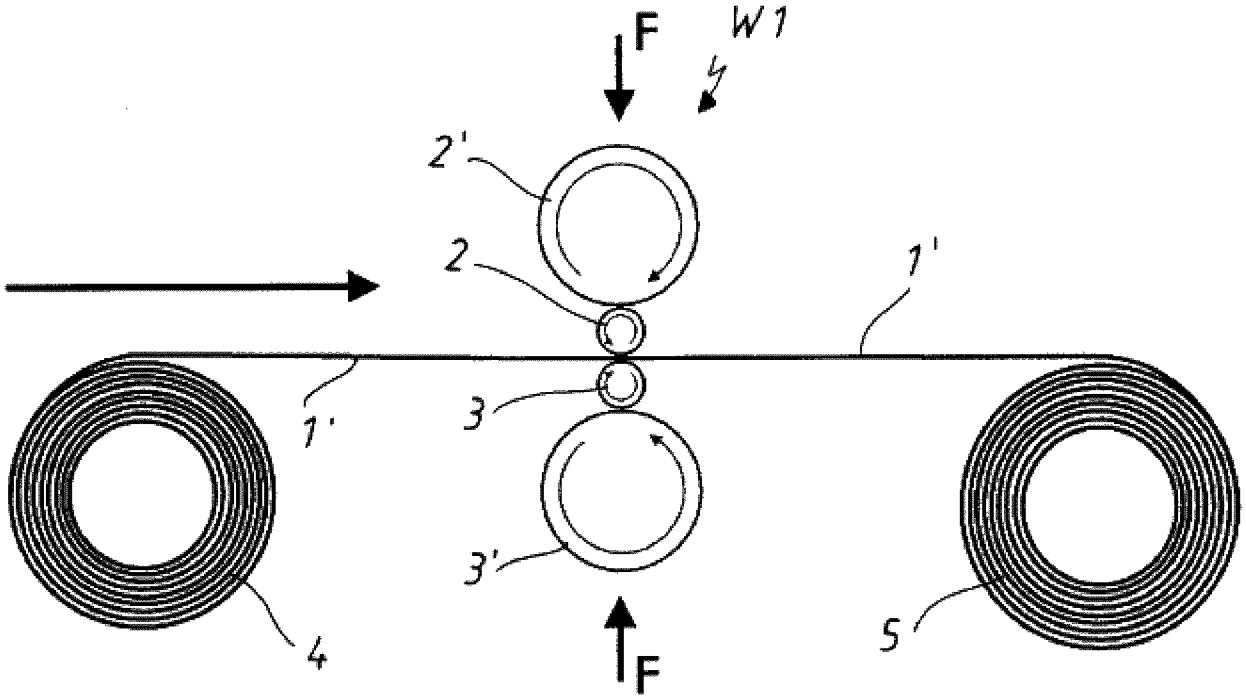
Figure 4:
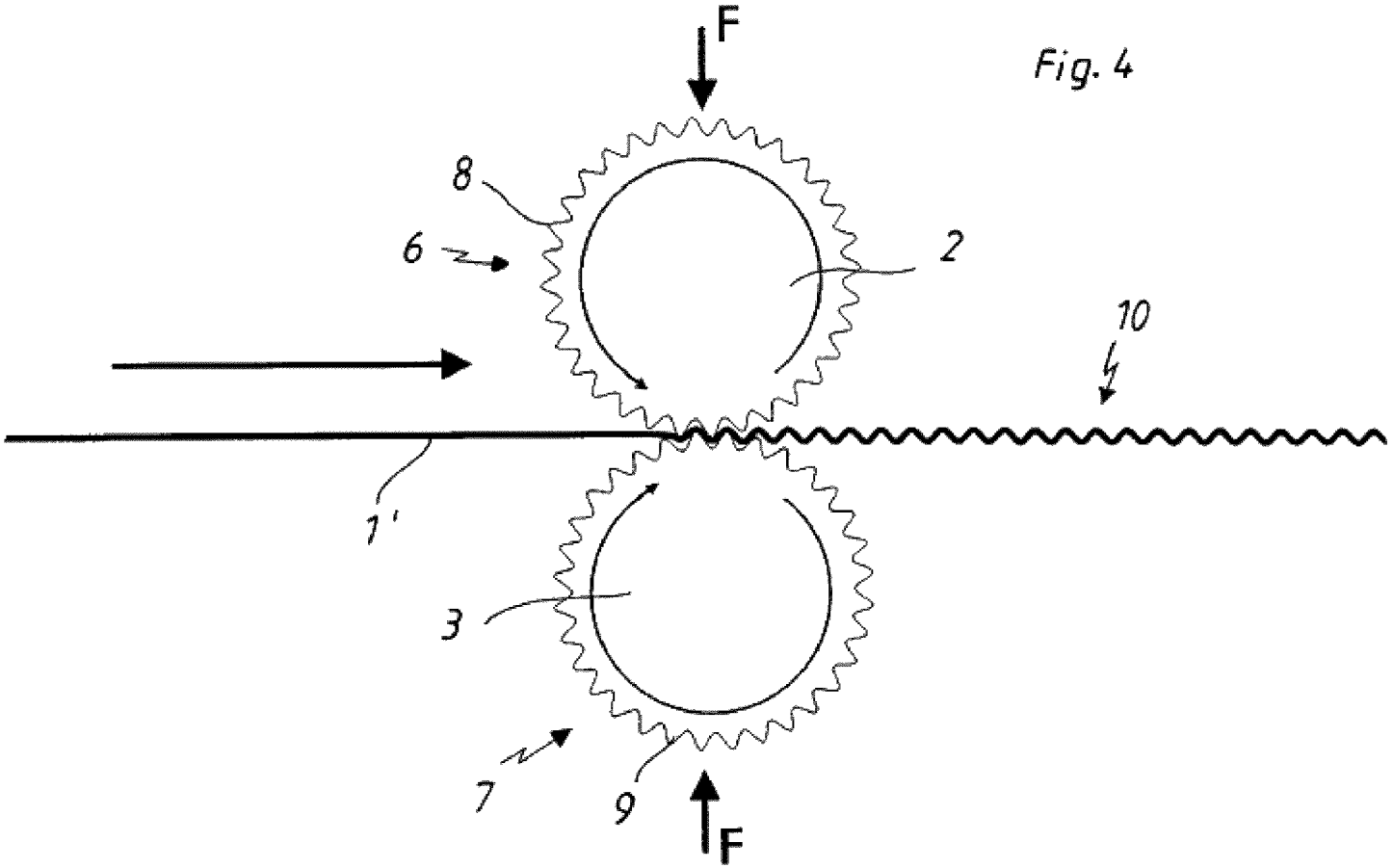
Figure 5:
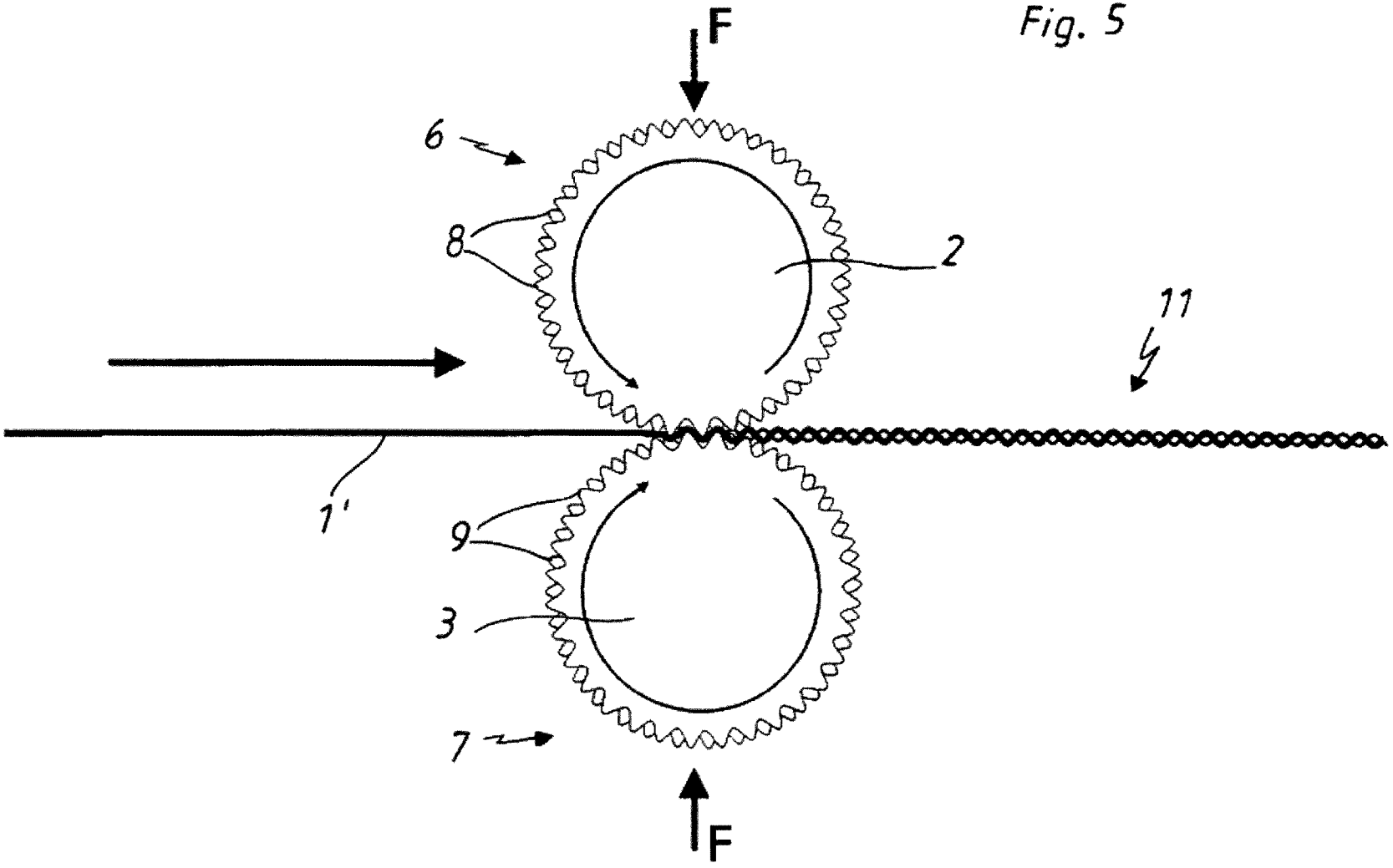
Figure 6:
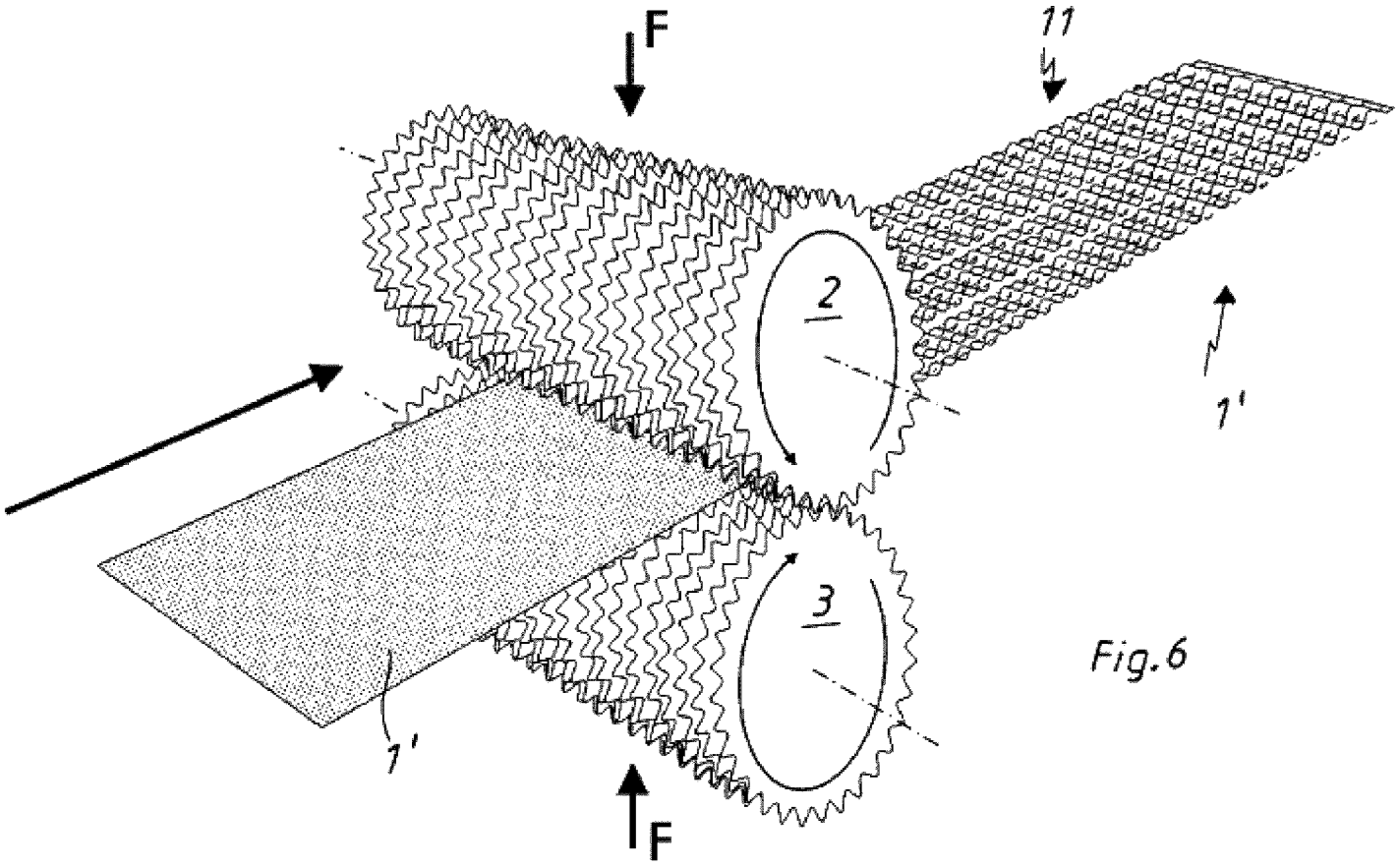
Figure 7:
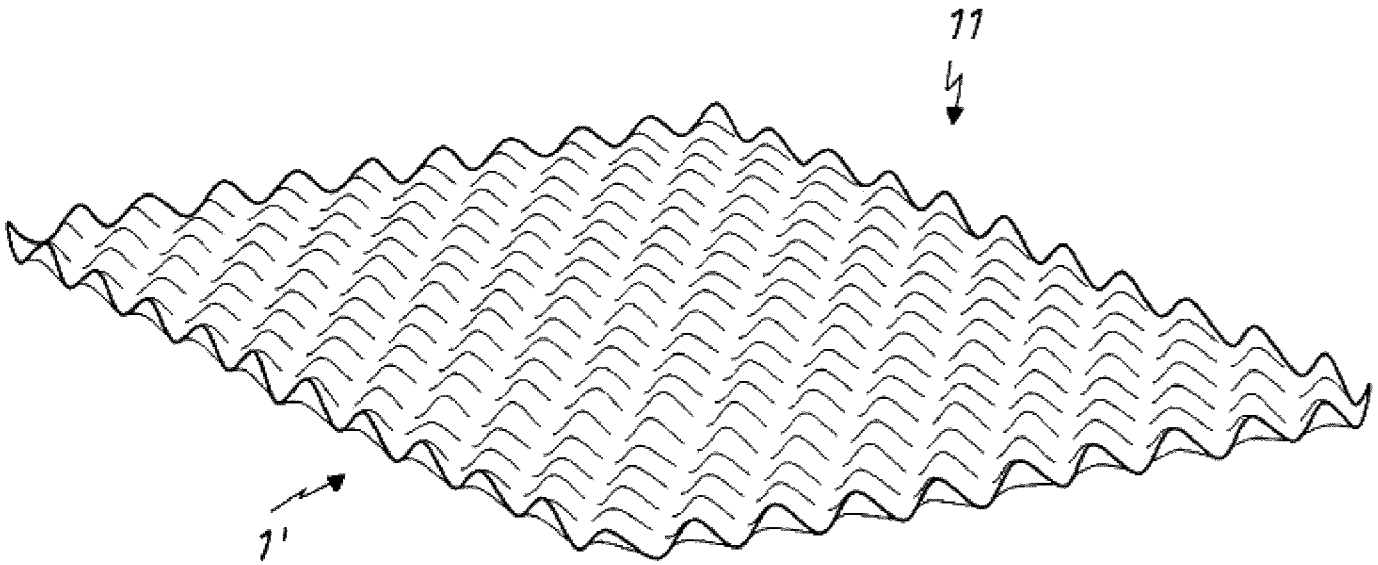
Figure 8:
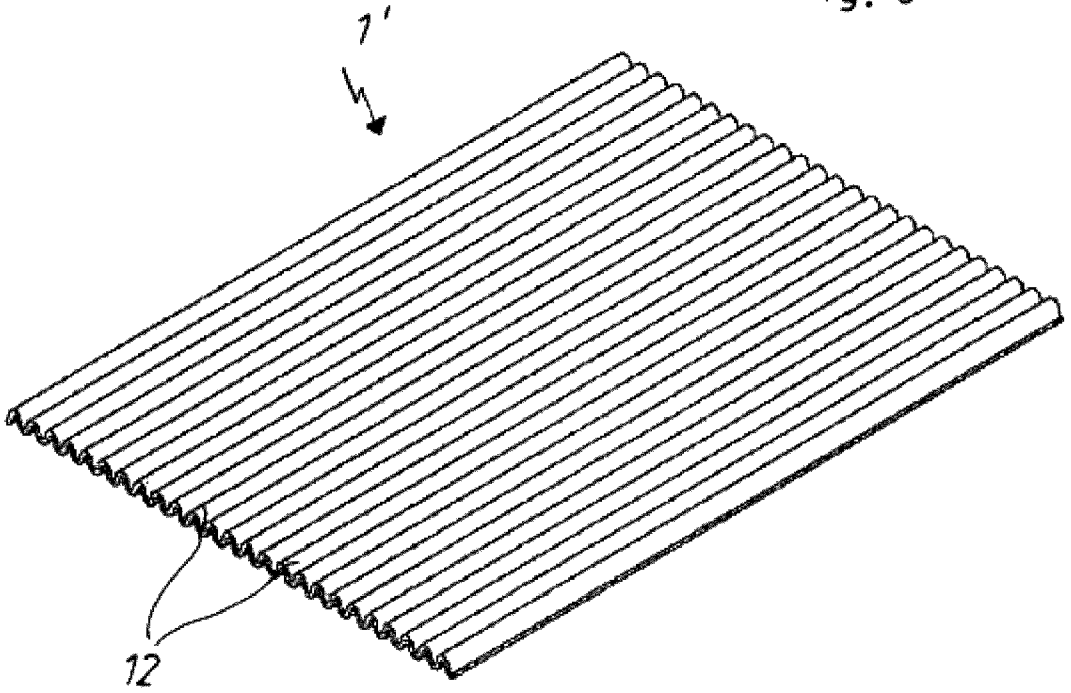

An exemplary embodiment of the object of the invention is illustrated in the drawings and described in greater detail below. In these drawings:

FIG. 1 shows a schematic diagram of different rolling stands for profiling a metal strip, FIG. 2 shows a chart of deformation criteria, FIG. 3 shows a schematic diagram of a metal strip that is wound up on a coil with subsequent cold deformation and another coiling operation, FIG. 4 and FIG. 5 show different roll topographies for producing different profiles in the respective metal strip, FIG. 6 shows a perspective representation of a profiling process of a metal strip, FIG. 7 shows a schematic diagram of a profiled metal strip, FIG. 8 shows a schematic diagram of an alternatively profiled metal strip.

DETAILED DESCRIPTION OF THE INVENTION

FIG. 1 shows a schematic diagram of several exemplary rolling stands W1 to W4, by means of which diverse profiles can be produced in a metal strip 1 consisting, for example, of stainless steel. In this context, the topography of the upper working roll 2 and the lower working roll 3 that effectively interact directly with the metal strip 1 is particularly important. The respective rolling stands W1, W2, W3, W4 are illustrated in the form of a side view. The metal strip 1 is guided through the respective rolling stands W1 to W4 in the direction of the arrow.

The lower portion of FIG. 1 shows the topographies of the upper working roll 2, the lower working roll 3 and the metal strip 1 passing between these working rolls, wherein the topographies are illustrated in the form of a longitudinal view in this case. In this example, the metal strip 1 should be provided with a wave structure.

FIG. 2 shows a chart of the deformation criteria of a metal strip in order to produce a wave profile or nub profile. The profile implies a 40% deformation of the metal strip. This extreme deformation can only be achieved with select steel materials. The dimensions shown (radii, angles and strip thickness) must be precisely observed because the metal strip otherwise tears or the respective rolling stand is damaged. The fitting accuracy of the upper and the lower roll is extremely important. Dimensional deviations <1% need to be observed because the rolls would otherwise shift relative to one another such that the rolling stand could be damaged or even destroyed.

FIG. 3 shows a schematic diagram of a metal strip 1' that is wound up on a coil 4. The rolling direction is indicated with an arrow. With consideration of FIG. 1, this figure merely shows a so-called 4-high rolling stand W1 containing an upper roll 2 and a lower roll 3. Corresponding forces F are exerted in the direction of the metal strip 1' by means of additional rolls 2', 3' that effectively interact with the rolls 2, 3. After the metal strip 1' has passed through the rolling stand W1, the metal strip 1' is once again wound up on another coil 5.

FIGS. 4 and 5 represent enhancements of FIG. 3. Only the upper roll 2 and the lower roll 3 are shown in order to provide a better overview. The surfaces 6, 7 of the rolls 2, 3 that face the metal strip 1' are provided with different topographies 8, 9 in order to produce different nub structures, wherein said topographies engage into one another—as illustrated in FIGS. 4 and 5—such that the metal strip 1' can freely flow between the upper roll 2 and the lower roll 3.

For example, if a stainless steel sheet of the material type 1.4301 should be profiled, this measure allows a thickness reduction of up to 45%. The profiles 10, 11 in the metal strip 1' that can be adjusted by means of the respective topographies 8, 9 of the rolls 2, 3 are illustrated in the right portion of FIGS. 4 and 5.

FIG. 6 corresponds to FIG. 5, but shows a perspective representation. This figure shows the upper roll 2, the lower roll 3 and the metal strip 1'. The rolling direction is also indicated with an arrow in this case. The metal strip 1' being unwound from the not-shown coil is guided through the rolls 2, 3, wherein the profile 11 is subsequently realized. According to FIG. 3, this profiled metal strip 1' subsequently can be once again wound up on a coil. Depending on the intended use of the profiled metal strip 1', the profiled coils could be subjected to an annealing process after the rolling operation in order to restore the original deformability of the sheet metal. Such an annealed profile makes it possible to manufacture components with significantly improved rigidity and reduced sheet metal thickness by means of suitable forming measures.

FIG. 7 shows a schematic diagram of a section of a profiled metal strip 1'. In this case, for example, the profiles 11 according to FIG. 6 can be produced in the metal strip 1'.

FIG. 8 shows a schematic diagram of an embodiment of a metal strip 1', in which the profiles 12 are realized in the form of a wave structure.

SEQUENCE LISTING

Not Applicable.

The invention claimed is:

1. A method for manufacturing profiled metal strips and maximizing profile depth, characterized in that a metal strip with predefinable original material thickness consisting of stainless steel is wound up on a coil and guided through a rolling stand containing several rolls, wherein at least the rolls that effectively interact with the metal strip are provided with a predefinable positive and negative topography, which at least partly engage into one another, and by means of which profiles with profile depths >250 μm for wave profiles or nub profiles can be produced on both sides of the metal strip depending on the geometry of the topography of the rolls, and the thickness of the metal strip to be rolled is adjusted with the rolling force, the profiles forming wave or nub profiles, the profiles having a wavelength and an amplitude, and having crests with radii, such that the radii is greater than 0.4× the original material thickness of the metal strip, and wherein the amplitude is equal to or less than 0.6× the wavelength.

2. The method according to claim 1, characterized in that nub structures or wave structures with profile depths >250 μm are produced in the metal strip being unwound from the coil.

3. The method according to claim 1, characterized in that rolling stands with at least 4 rolls are used for profiling the metal strip.

4. The method according to claim 1, characterized in that at least one of the following marginal conditions is fulfilled in order to achieve the maximum material-dependent profile depth for wave profiles or nub profiles:

1. The wavelength of the topography profile is greater than 3× original sheet metal thickness;
2. The angle in the flank of the topography profile parallel to the rolling direction is greater than 30° ;
3. The amplitude or the thickness of the profiled sheet metal to be rolled are adjusted with the rolling force.

5. The method according to claim 1, characterized in that a material of the type 1.4301 is used in a metal strip consisting of stainless steel, wherein the maximum thickness reduction of this material during the course of the rolling operation amounts up to 45%.

6. The method according to claim 1, characterized in that positive and negative surface topographies are produced on the rolls that effectively interact with the metal strip without impairing the flow of the metal strip material, such that impression depths >1000 μm can be realized at a predefinable rolling force.

* * * * *